US010031468B2

(12) United States Patent
Endo et al.

(10) Patent No.: US 10,031,468 B2
(45) Date of Patent: Jul. 24, 2018

(54) STRUCTURE AND STRUCTURE DETACHABLY MOUNTABLE TO IMAGE FORMING APPARATUS

(71) Applicant: CANON KABUSHIKI KAISHA, Tokyo (JP)

(72) Inventors: Michiaki Endo, Abiko (JP); Shoji Sasaki, Yokohama (JP); Yoshiharu Irei, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/251,473

(22) Filed: Aug. 30, 2016

(65) Prior Publication Data

US 2017/0068208 A1 Mar. 9, 2017

(30) Foreign Application Priority Data

Sep. 8, 2015 (JP) ..... 2015-176440

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS 5,327,695 A * 7/1994 Kelly ..... F16B 17/002 14/74.5
5,570,159 A 10/1996 Hirose et al.
2003/0161651 A1* 8/2003 Tatematsu ..... G03G 15/2039 399/69
2007/0280777 A1 12/2007 Fan
2015/0370201 A1* 12/2015 Watatani ..... G03G 15/206 399/328
2015/0381837 A1 12/2015 Oizumi

FOREIGN PATENT DOCUMENTS

JP 086342 A 1/1996

OTHER PUBLICATIONS

Great Britain Office Action dated Feb. 14, 2017, in related Great Britain Application No. GB1614949.4.

* cited by examiner

*Primary Examiner* — Victor Verbitsky
(74) *Attorney, Agent, or Firm* — Fitzpatrick, Cella, Harper & Scinto

(57) ABSTRACT

A structure includes a first frame including a slit portion; and a second frame including a plate portion configured to enter the slit portion. The slit portion includes an introducing portion, a first positioning portion, and a first tapered portion connecting the introducing portion and the first positioning portion. The plate portion includes a free end portion capable of entering the introducing portion, a second positioning portion determining a position of the plate portion with respect to a longitudinal direction of the slit portion, a third positioning portion determining a position of the plate portion with respect to an inserting direction into the slit portion, and a second tapered portion contactable to the first tapered portion and connecting the free end portion and the second positioning portion.

22 Claims, 16 Drawing Sheets

STRUCTURE AND STRUCTURE DETACHABLY MOUNTABLE TO IMAGE FORMING APPARATUS

FIELD OF THE INVENTION AND RELATED ART

The present invention relates to a structure and a structure detachably mountable to an image forming apparatus. As the image forming apparatus, it is possible to use a copying machine, a printer, a facsimile machine and a multi-function machine having a plurality of functions of these machines.

The structure for OA (office automation) equipment such as the copying machine, the facsimile machine or the printer is required to simultaneously have strength of the structure itself and positional accuracy in some cases. In order to realize the strength and the positional accuracy, there is a method in which a jig exclusively for assembling of the structure is used. A plurality of parts are combined and the structure is bonded by welding or fastening with a screw. The method is not a problem in the case where the structure is assembled and then is not disassembled.

However, in the case of the OA equipment such as the copying machine, the facsimile machine or the printer, a unit is demounted from the structure as a main body in some cases during maintenance or periodical exchange of parts. Then, in some cases, an operation in which the unit itself is exchanged to a fresh (new) unit or a some part in the unit is exchanged and then the unit is mounted again to the structure as the main body is performed.

When such an operation is performed, a person for performing the operation is a service person or a user himself (herself). An operation place is an office or the like in which the OA equipment such as the copying machine, the facsimile machine or the printer is actually placed. Therefore, an exclusive tool such as an assembling jig cannot be used, and in addition, ease of the operation itself is also required.

Accordingly, the unit and the parts or the like of the copying machine or the like may desirably have a constitution of a structure capable of reproducing assembly accuracy before assembling without relying upon the assembly jig when the unit and the parts are disassembled and then are assembled again.

Reference Example 1 having a constitution realizing the structure constitution is shown in FIG. 13. An upright metal plate frame X1 is 0.2 mm in thickness and is provided with an irregular-shaped hole X2. On the other hand, a metal plate stay X3 is 1.2 mm in thickness is provided so as to be combined and connected with the metal plate frame X1. The stay X3 is provided with an irregular-shaped projection X4.

In Reference Example 1, a dimension of the irregular-shaped hole X2 is set so that a width B is 16 mm and a tolerance of the width B is a fit tolerance H9 defined by JIS and so that a height H is 1.2 mm and a tolerance of the height H is +0.01-0 mm. A dimension of the projection X4 of the stay X3 is set so that a width L is 16 mm and a tolerance of the width L is a fit tolerance f9 and so that a height is 1.2 mm (as a plate thickness) and a tolerance of the height is ±0.07 mm as a metal plate thickness tolerance.

When the stay X3 is assembled with the frame X1, the stay X3 is moved in an arrow X6 direction. The projection X4 of the stay X3 is inserted into the irregular-shaped hole of the frame X1. At this time, a dimensional relationship between the irregular-shaped hole X2 and the projection X4 is such that the hole X2 and the projection X4 are engaged with each other as described above and therefore positioning of the stay X3 relative to the frame X1 is made. Such engaging portions X2 and X4 are provided in a plurality of pairs (not shown, a loose widthwise relationship is established from a second pair and subsequent pairs). Connection (fixing) between the frame X1 and the stay X3 is made in such a manner that a bent portion X7 is provided with a tap at an end portion of the stay X3 and the frame X1 is provided with a hole through with the tap is fixed with a screw.

Further, there is a positioning method or the like disclosed in Japanese Laid-Open Patent Application (JP-A) H08-6342.

However, in Reference Example 1, there is a liability as described below. In the case where exchange of parts or the like is periodically made during continuous operation of the copying machine or the like, various forms of the structure exist depending on its purpose (use).

FIG. 14 shows a state in which a frame 1 and a frame 2 are combined with each other in Reference Example 2. Each of the frames 1 and 2 is formed of metal plate of 1.2 mm in thickness. The frame 1 includes a plurality of inserting portions Y1 and Y2 between which a large cut-away portion Y3 exists.

In such a case, a slight deviation can be generated between the inserting portions Y1 and Y2 with respect to a thickness direction (arrow K direction). Originally, irregular-shaped holes Y4 and Y5 provided in the frame 2 are holes for regulating the frame 1 with respect to a plate thickness direction. For that reason, even when the slight deviation is generated in the frame 1, inserting portions of the frame 2 cannot engage with the inserting portions Y1 and Y2 of the frame 1 smoothly, so that an assembling operation property of the frame 2 with the frame 1 was lowered in some cases.

FIG. 15 shows a state in which a frame 3 and a frame 4 are combined with each other in Reference Example 3. A difference from Reference Example 1 is that a frame 3 has a box-like shape including front and rear side plates 31 and 32 provided with unit inserting portions 33, 34 and 35.

Then, the unit inserting portions 33, 34 and 35 of the front and rear side plates 31 and 32 engage with engaging holes 41, 42 and 43, respectively, provided in the frame 4, and a distance between the front and rear side plates 31 and 32 is maintained by an interval Q between the engaging holes of the frame 4. Thus, in the case where the unit inserting portions 33, 34 and 35 are disposed at positions spaced between the front side plate and the rear side plate, leaning of the front and rear side plates themselves generates, and therefore it becomes difficult to insert the front and rear side plates into positioning holes of the frame 4. Therefore, operativity of an assemble operation was lowered.

SUMMARY OF THE INVENTION

According to an aspect of the present invention, there is provided a structure comprising: a first frame including a slit portion; and a second frame including a plate portion configured to enter the slit portion to determine a position of the second frame relative to the first frame, wherein the slit portion includes an introducing portion having a width larger than a thickness of the plate portion, a first positioning portion configured to determine a position of the plate portion with respect to a widthwise direction of the slit portion, and a first tapered portion configured to connect the introducing portion and the first positioning portion, and wherein the plate portion includes a free end portion capable of entering the introducing portion, a second positioning portion configured to determine a position of the plate portion with respect to a longitudinal direction of the slit portion, a third positioning portion configured to determine a position of the plate portion with respect to an inserting direction into the slit portion, and a second tapered portion contactable to said first tapered portion and configured to connect the free end portion and the second positioning portion.

According to another aspect of the present invention, there is provided a structure detachably mountable to an image forming apparatus, comprising: a rotatable member; a first frame including a slit portion; and a second frame including a groove portion configured to rotatably hold the rotatable member and a plate portion configured to enter the slit portion to determine a position of the second frame relative to the first frame, wherein the slit portion includes an introducing portion having a width larger than a thickness of the plate portion, a first positioning portion configured to determine a position of the plate portion with respect to a widthwise direction of the slit portion, and a first tapered portion configured to connect the introducing portion and the first positioning portion, and wherein the plate portion includes a free end portion capable of entering the introducing portion, a second positioning portion configured to determine a position of the plate portion with respect to a longitudinal direction of the slit portion, a third positioning portion configured to determine a position of the plate portion with respect to an inserting direction into the slit portion, and a second tapered portion contactable to said first tapered portion and configured to connect the free end portion and the second positioning portion.

Further features of the present invention will become apparent from the following description of exemplary embodiments with reference to the attached drawings.

DESCRIPTION OF EMBODIMENTS

Embodiments of the present invention will be described with reference to the drawings.

<First Embodiment>

[Image Forming Apparatus]

Figure 2:
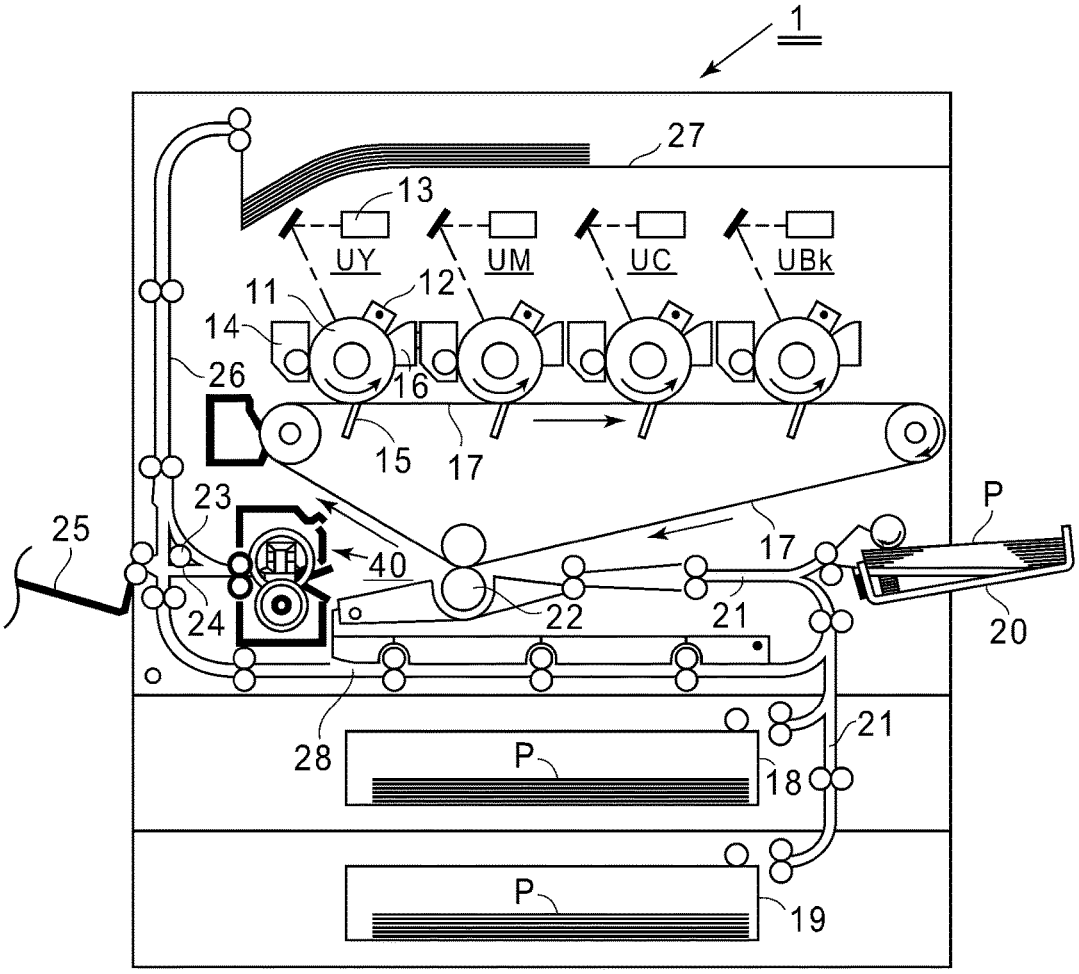
FIG. 2 is a schematic structural view of an example of an image forming apparatus.

FIG. 2 is a schematic sectional view of an example of an image forming apparatus 1. This image forming apparatus is a full-color electrophotographic printer of a tandem type and an intermediary transfer type and includes four image forming portions UY, UM, UC and UK for forming toner images of Y (yellow), M (magenta), C (cyan) and Bk (black), respectively.

Each of the image forming portions includes a photosensitive drum 11, a charger 12, a laser scanner 13, a developing device 14, a primary transfer charger 15 and a drum cleaner 16. Incidentally, for brevity, reference numerals of these devices in the image forming portions UM, UC and UBk other than the image forming portion UY are omitted from illustration. Further, an electrophotographic process and an image forming operation at these image forming portions are well-known and therefore will be omitted from description.

The respective color toner images are primary-transferred from the drums 11 of the respective image forming portions onto an intermediary transfer belt 17 in a predetermined superposition manner. As a result, the four color toner images which are superposed are formed on the belt 17. On the other hand, one sheet of a sheet-like recording material P is fed from a cassette 18 or 19 or from a manual-feeding tray 20 and then introduced through a feeding path 21 into a secondary transfer nip which is a press-contact portion between the belt 17 and a secondary transfer roller 22 at predetermined timing. As a result, the four-color superposed toner images are secondary-transferred altogether from the belt 17 onto the recording material P. The recording material P is introduced into a fixing device 40, and the toner images are fixed on the recording material P.

The recording material P coming out of the fixing device 40 is, in the case of an operation in a one-sided image forming mode, introduced into a feeding path 24 by control of a flapper 23 and then is discharged face down (with an image surface downward) onto a discharge tray 25. Alternatively, the recording material P is introduced into a feeding path 26 and then is discharged face up (with the image surface upward) onto a discharge tray 27.

In the case of an operation in a double-sided image forming mode, the recording material P coming out of the fixing device 40 is once introduced into a feeding path 26 side by the control of the flapper 23 and thereafter is fed into a feeding path 28 for the double-sided image forming mode in a switch-back manner. Then, the recording material P is fed again into the secondary transfer nip through the feeding path 21 in a state in which the recording material P is turned upside down. Thereafter, similarly as in the case of the operation in the one-sided image forming mode, the recording material P is introduced into the fixing device 40 and then is discharged as a double-sided image-formed product onto the discharge tray 25 and 27.

[Fixing Device]

Figure 3:
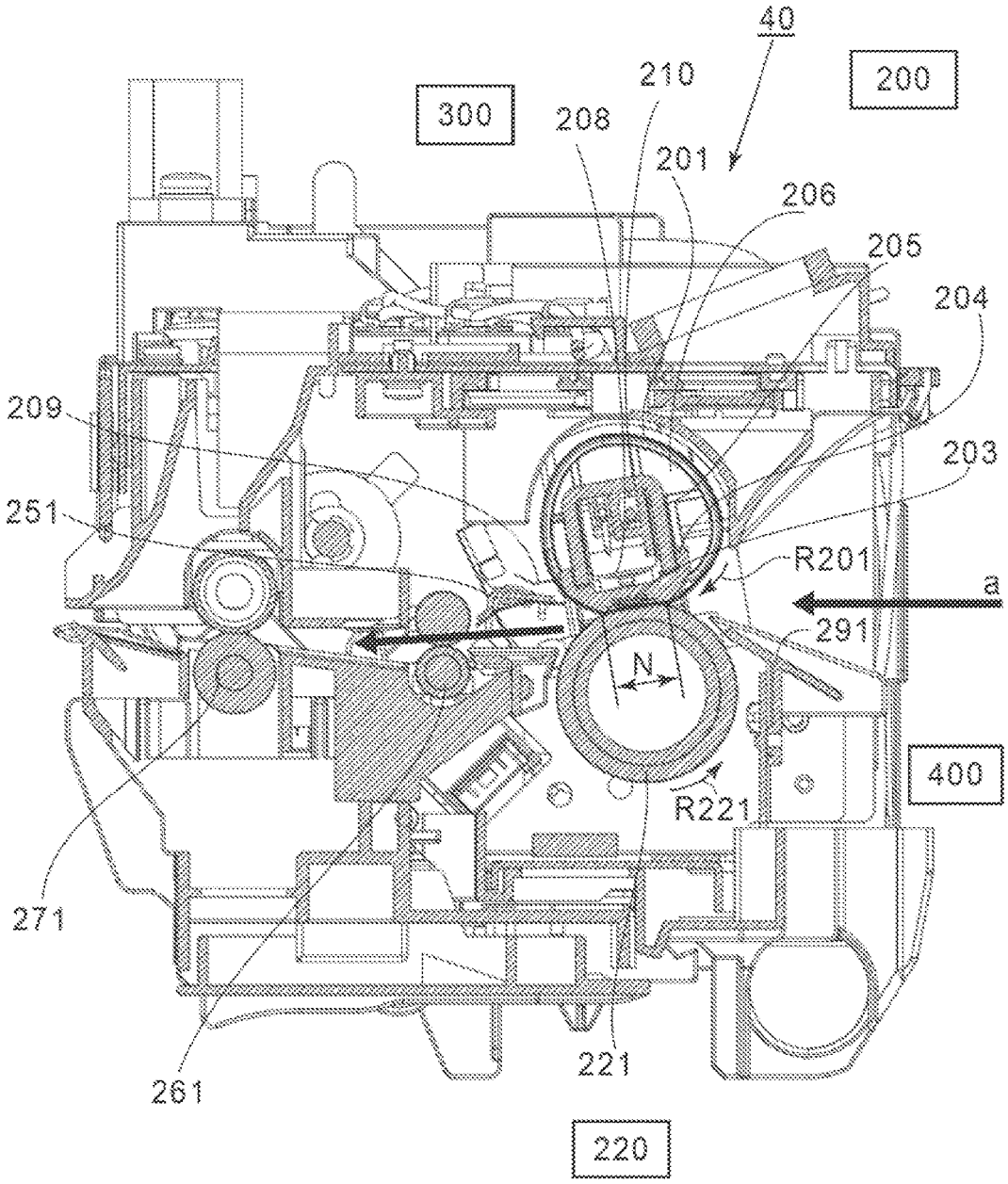
FIG. 3 is a sectional view of a fixing device.

FIG. 3 shows a principal cross-section of the fixing device 40 mounted in the image forming apparatus 1. This fixing device 4 is a fixing device of a film (belt) heating type and a pressing member driving type. A fixing device constitution and a fixing operation of the fixing device are well-known and therefore will be described briefly.

Figure 4:
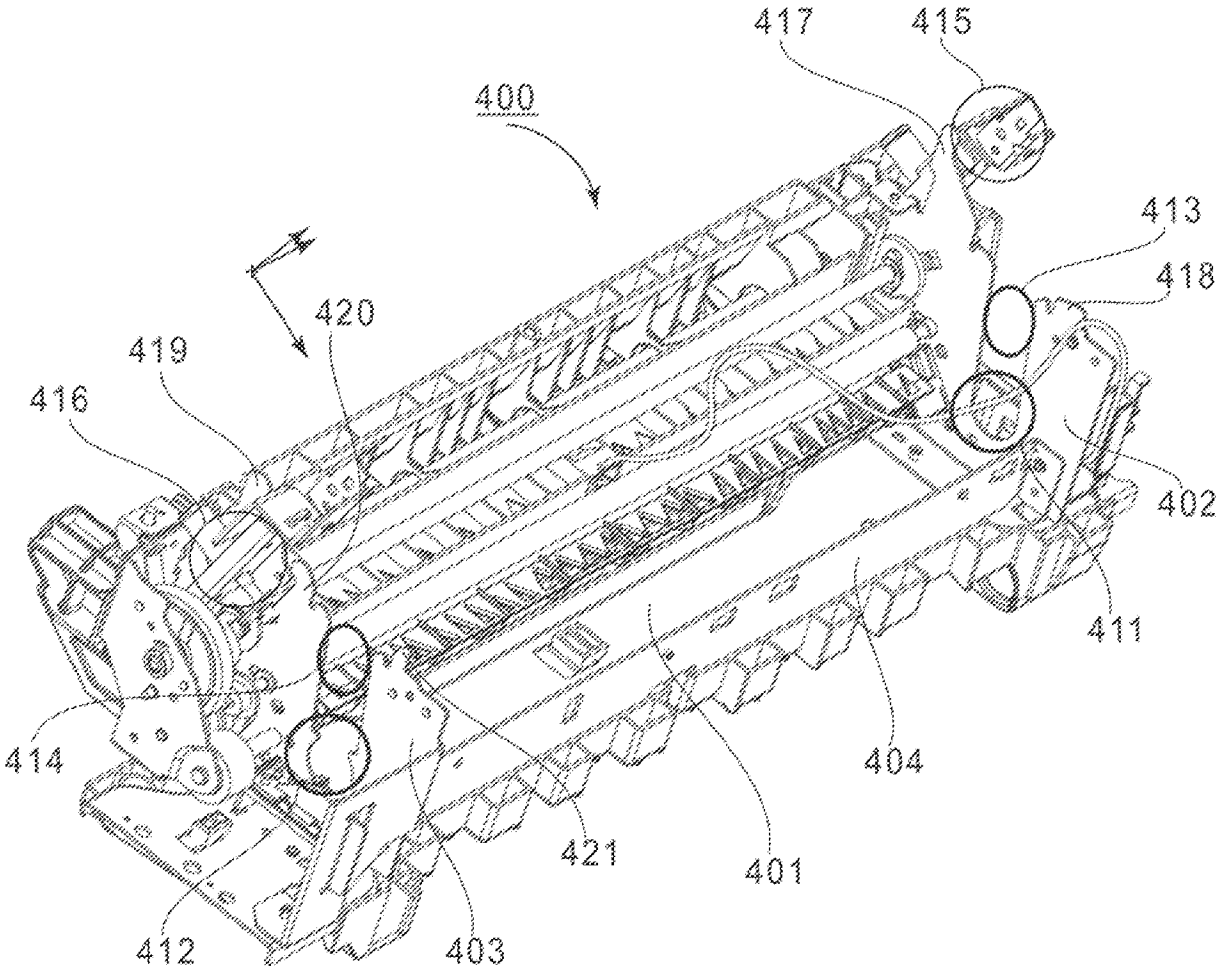
FIG. 4 is a perspective view of a fixing film unit.

The fixing device 40 roughly includes a fixing device frame unit 400, a fixing film unit 200 as a heating member assembled with the fixing device frame unit 400, a pressing roller unit 220 as a pressing member, and a shutter unit 300. Further, the fixing device 40 includes a fixing device entrance guide 291, a separation plate 251, a feeding roller pair 261, a feeding roller pair 271, a pressing mechanism 415 (FIG. 4), and a pressing mechanism 416 (FIG. 4). Details of principal units will be described below.

(Fixing Film Unit 200)

Figure 6:
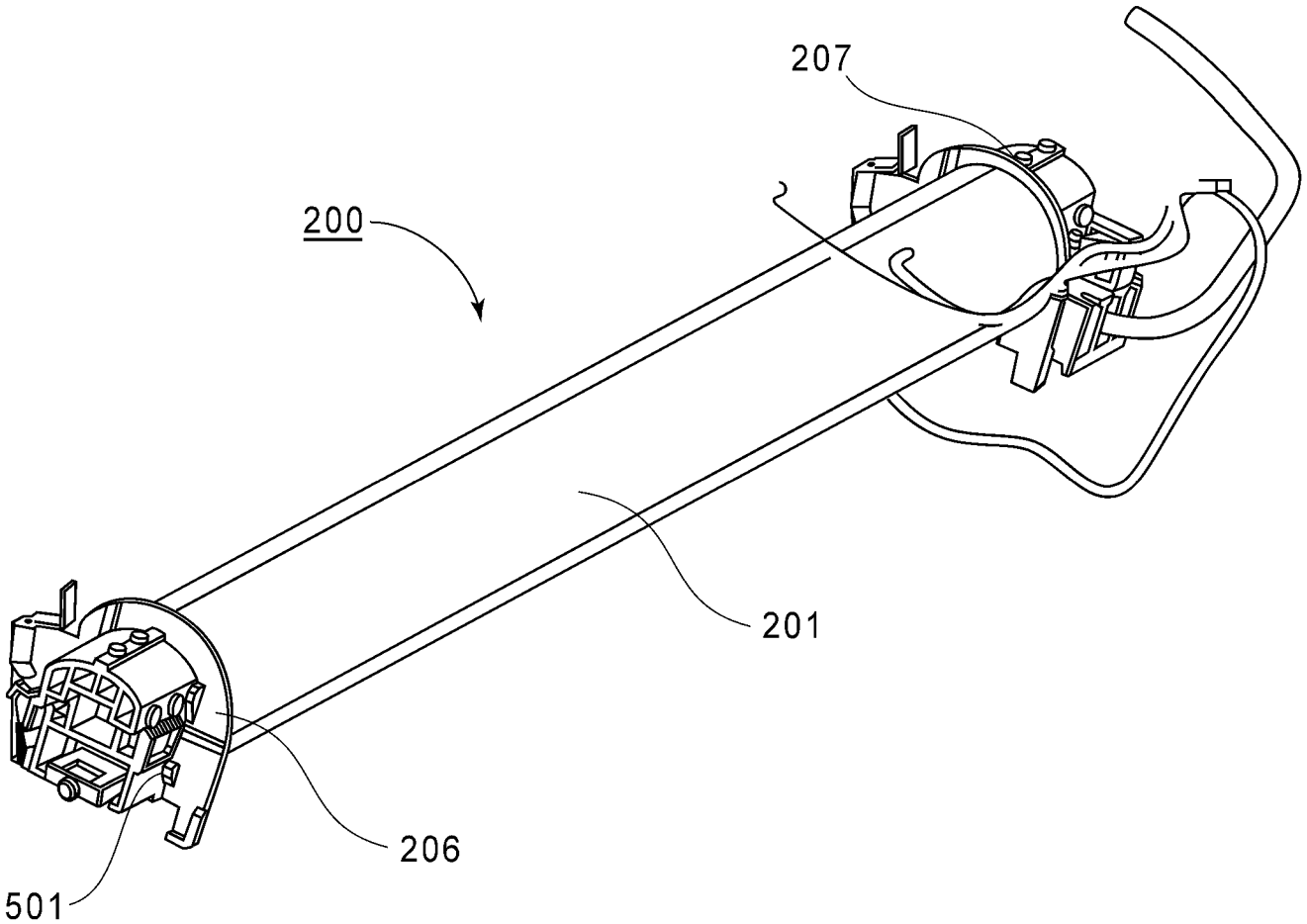
FIG. 6 is a perspective view of a fixing device frame unit.

FIG. 6 is a perspective view of an outer appearance of the fixing film unit 200. Referring to FIGS. 3 and 6, a fixing film 201 is a cylindrical heat-resistant member as a heating member for conducting heat to the recording material P. An inner diameter of the fixing film 201 is set at 30 mm, and an inner peripheral length is set at 102% of an outer peripheral length of members consisting of a ceramic heater 203, a heater holder 204 and fixing flanges 206 and 207, so that the fixing film 201 is externally fitted around the members somewhat loosely. The fixing film 201 is a composite length film obtained by coating an outer peripheral surface of a 50 μm-thick heat-resistant polyamideimide film with a PFA tube. The fixing film 201 may also be formed of metal.

The ceramic heater 203 has a basic constitution in which a thin elongated ceramic substrate and an energization heat generating resistor length provided on a surface of the substrate are combined, and is a low-thermal capacity heater which increases in temperature with an abrupt rising characteristic as a whole.

The ceramic heater 203 is fixed to the heater holder 204 with a heat-resistant adhesive. Downstream of the heater holder 204 with respect to a recording material feeding direction a, a projection is provided for the purposes of enlargement of a fixing nip width and improvement in separation (property) of the recording material P from the fixing film 201.

A stay 205 is pressed against a surface of the heater holder 204, formed of a liquid crystal polymer material, where there is no heater 203, so that strength is imparted to the heater holder 204 and the heater 203 and a fixing nip N is ensured. In addition, the stay 205 is connected with the fixing flanges 206 and 207 and thus ensures strength of the fixing film unit 200. As a material of the stay 203, a 2.3 mm-thick electroplated zinc steel plate is used, and the stay 203 is molded in a U-shape in cross-section to ensure strength thereof and then is used.

The fixing flanges 205 and 207 are engaged in both longitudinal ends of the stay 205. The fixing flanges 206 and 207 slide with the inner peripheral surface of the fixing film 201 and determine a locus of the fixing film 201 with respect to a rotational direction of the fixing film 201. In addition, the fixing flanges 206 and 207 abut against a front end portion (one end side) and a rear end portion (the other end side), respectively, of the fixing film 201 and thus determine a position of the fixing film 201 in the fixing device with respect to the longitudinal direction. As a material of the fixing flanges 206 and 207, a liquid crystal polymer resin material having both of a heat-resistant property and a sliding property is used. The fixing flanges 206 and 207 are, as described later, engaged with and held by side plates of the fixing device frame unit 400 and are disposed at positions shown in FIGS. 3 and 6.

In a space enclosed by the stay 205 and the heater holder 204, a heater thermistor 208 and a film thermistor 209 are supported by a thermistor holder 210 in order to detect and control a temperature of the heater 203. A controller (not shown) adjusts the ceramic heater temperature so that a temperature of the fixing film 201 is a temperature depending on each of recording materials P of various species by a temperature-control system including the thermistors 208 and 209.

(Pressing Roller Unit 220)

Figure 5:
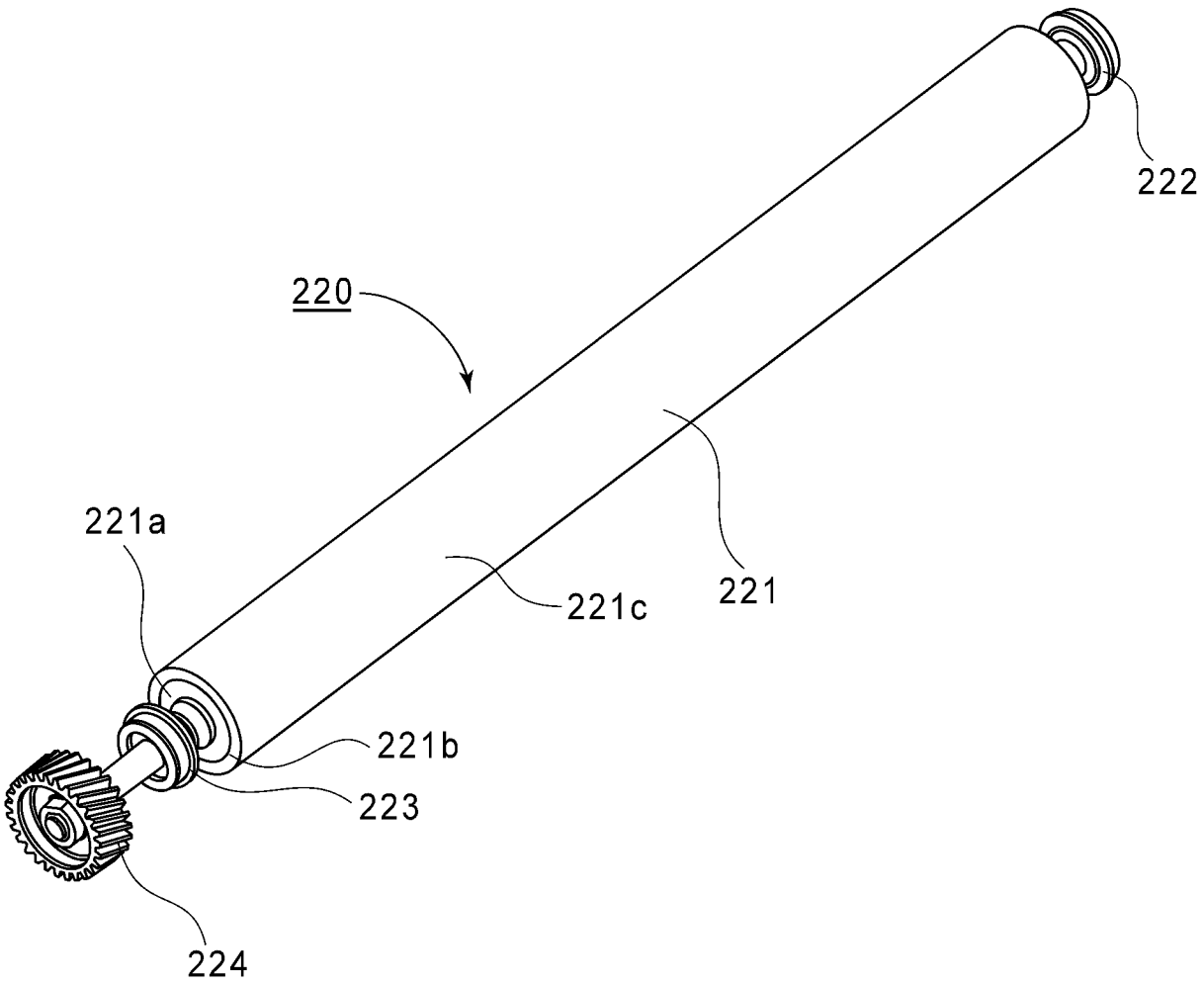
FIG. 5 is a perspective view of a pressing roller unit.

FIG. 5 is a perspective view of an outer appearance of the pressing roller unit 220. The pressing roller unit 220 includes a pressing roller 221. The pressing roller 221 is constituted by a core metal 221*a* formed of a mild (soft) steel, an elastic layer 221*b*, which is molded concentrically integrally with the core metal 221*a* and which is coated on an outer peripheral surface of the core metal 221*a* with a silicone rubber material, and a parting layer consisting of a PFA tube 221*c* as a surface layer. An outer diameter of the pressing roller 221 is 30 mm. The pressing roller 221 is, as described later, rotatably supported by the side plates of the fixing device frame unit 400 via bearings 222 and 223.

To a gear 224 mounted to the core metal 221*a*, a driving force of a driving motor (not shown) controlled by the controller is transmitted. As a result, the pressing roller 221 is rotationally driven at a predetermined peripheral speed in the counterclockwise direction of an arrow R221 in FIG. 3. A portion formed by press-contact between the pressing roller 221 and the fixing film 201 is referred to as the fixing nip N. The pressing roller 221 is rotationally driven as described above, whereby the fixing film 201 of the fixing film unit 200 is rotated in the clockwise direction of an arrow R201 by the rotation of the pressing roller 221 while being slid in close contact with the heater 203 at an inner surface thereof.

The recording material on which an unfixed toner image is placed enters the pressing nip N as shown by an arrow a in FIG. 3 and then is nipped and fed. As a result, heating and pressing of the recording material are simultaneously effected in the fixing nip N, so that the toner image is fixed as a fixed image on the recording material. The recording material on which the toner image is fixed at the fixing nip N is separated from the fixing film 201 by the separation plate 251, and then is discharged from the fixing device 40 by the feeding roller pairs 261 and 271.

(Shutter Unit 300)

A temperature of a part of the fixing film 201 is increased by continuously introducing (passing) a large number of sheets of the recording materials into (through) the fixing nip N in some cases. When such a situation continues, the image on the recording material as a product causes an abnormal image in some cases. In order to prevent the abnormal image, cooling air is blown onto the fixing film 201 for maintaining suitability for the temperature of the fixing film 201 in some cases. The shutter unit 300 is a unit for controlling the cooling air toward the fixing film 201.

Figure 7:
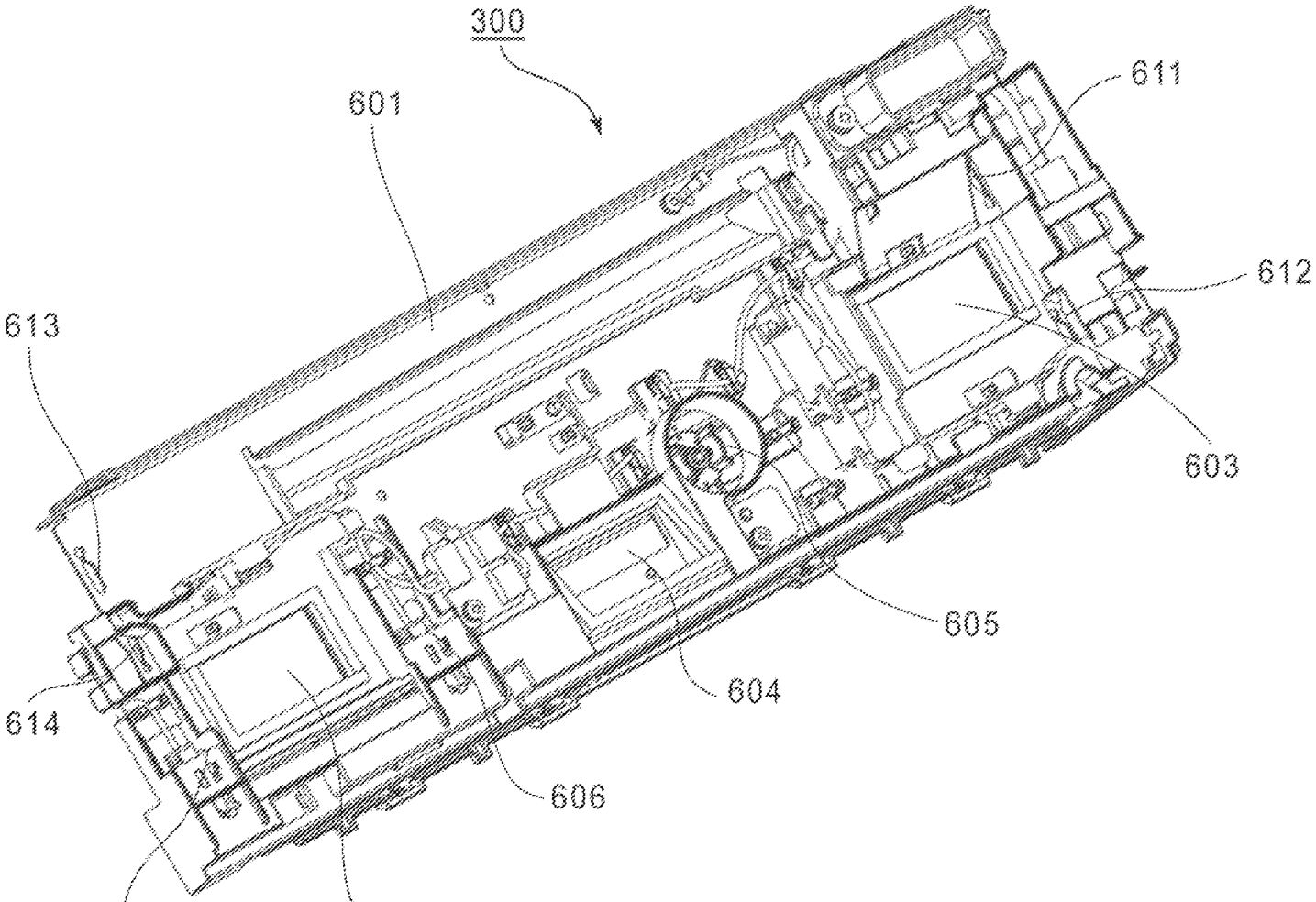
FIG. 7 is a perspective view of a shutter unit.

FIG. 7 is a perspective view of an outer appearance of the shutter unit 300. A shutter (not shown) provided in the shutter unit 300 is opened, so that the cooling air from a fan (not shown) in an image forming apparatus main assembly is taken into the fixing device 40 and thus the fixing film temperature is made suitable. Although details will be described later, when the shutter unit 300 is combined with the fixing device frame unit 400, the shutter unit 300 functions also as a strength member for maintaining strength as the fixing device 40.

(Periodical Exchange Parts (Components))

The fixing film 201 and the pressing roller 221 cause deterioration of the PFA layer, as the surface layer, and the rubber layer with repetition of heating and pressing of the recording material, and thus cannot satisfy an initial image performance. Therefore, the fixing film 201 and the pressing roller 221 are set as periodically exchanged parts. In the case of the fixing device in this embodiment, when as an integrated value, an about 300,000 sheets of A4-sized recording materials are introduced, exchange of the fixing film 201 and the pressing roller 221 is recommended. That is, in this embodiment, the fixing device 40 is a structure (unit) mounted in the main assembly of the image forming apparatus holding the parts to be exchanged.

FIG. 4 is a perspective view showing a state in which the shutter unit 300, the fixing film unit 200 and the pressing roller unit 210 are demounted from the fixing device 40 and thus only the fixing device frame unit 400 is shown.

The fixing device frame unit 400 includes a fixing device frame 401, a front side plate (one end side plate) 402, a rear side plate (the other end side plate) 403, and an entrance guide supporting plate 404 which are parts for ensuring basic strength of the fixing device frame unit 400 and which are formed using a 1.2 mm-thick zin-coated steel plate. An arcuate portion 411 of the front side plate 402 and an arcuate portion 412 of the rear side plate 403 are places where the bearing 222 and 223 (FIG. 5) of the pressing roller unit 210 are engaged, respectively.

A cut-away portion 413 of the front side plate 402 and a cut-away portion 414 of the rear side plate 403 are positioning portions for the fixing film unit 200. With the cut-away portions 413 and 414, positioning portions of the fixing flanges 206 and 207 are engaged, so that the fixing film unit 200 move along the cut-away portion 413 of the front side plate 402 and the cut-away portion 414 of the rear side plate 403. In order to facilitate a mounting and demounting operation of the fixing film unit 200 and the pressing roller unit 210 relative to the fixing device frame unit 400, parts of the front and rear side plates 402 and 403 are cut away as openings.

A front pressing mechanism 415 and a rear pressing mechanism 416 are mechanisms for engaging with top portions of the fixing flanges 206 and 207 (FIG. 6), respectively, of the fixing film unit 200 to impart a predetermined pressure. During exchange of the fixing film unit 200 and the pressing roller unit 210, the front pressing mechanism 415 and the rear pressing mechanism 416 are in an open state as shown in FIG. 4.

The front side plate 402 is provided with positioning portions (inserting portions) 417 and 418 for positioning the shutter unit 300, and the rear side plate 403 is provided with positioning portions (inserting portions) 419, 420 and 421 for positioning the shutter unit 300. In order to improve an exchange operation property of the periodical exchange units, the front side plate 402 is provided with the cut-away portion 413, and therefore, leaning of the positioning portions 417 and 418 of the front side plate 402 may be generated so that positional deviation in a plate thickness direction is generated in some cases. Similarly, also the rear side plate 403 is provided with the cut away portion 414, so that the positioning portions (members) 419, 420 and 421 cause the positional deviation in the plate thickness direction in some cases.

Further, also between the front side plate 402 and the rear side plate 403, leaning is generated in an interval (spacing) between the front side plate 402 and the rear side plate 403 for the above-described reason.

In order to not only suppress the leaning of the above-described portions (members) but also maintain the interval between the front and rear side plates 402 and 403 at a certain value, a strength member may desirably be used. In this embodiment, as the strength member, an upper fixing stay 601 (FIG. 7) is provided, so that the degree of leaning of the front and rear side plates and the interval between the front and rear side plates are maintained at certain levels. An assembling problem can be generated, but a solution to the problem will be described later in detail.

Referring to FIG. 5 showing the pressing roller unit 220, at both end portions of the pressing roller 221, the bearings 222 and 223 are assembled so that the pressing roller 221 can be held rotatably relative to the fixing device frame unit 400. Further, also the gear 224 for transmitting a rotational (driving) force to the pressing roller 221 is mounted. When the pressing roller unit 210 is mounted to the fixing device frame unit 400, the bearings 222 and 223 are engaged with the arcuate portion 411 of the front side plate 402 and the arcuate portion 412 of the rear side plate 403, respectively.

Referring to FIG. 6 showing the fixing film unit 200, at both end portions of the fixing film 201, the fixing flanges 206 and 207 are mounted. The fixing flange 206 is provided with an engaging portion 501 engageable with the cut-away portion 414 of the rear side plate 403, so that the engaging portion 501 engages with the cut-away portion 414 in a translatable manner. The fixing flange 207 side is not illustrated in FIG. 6, but is constituted similarly as in the fixing flange 206 side.

As shown in FIGS. 4-6, by providing the front and rear side plates 402 and 403 with the cut-away portions 413 and 414, respectively, it is understood that exchange of the pressing roller unit 210 and the fixing film unit 200 relative to the fixing device frame unit 400 can be easily made.

Referring to FIG. 7 showing the shutter unit 300, the shutter unit 300 includes the upper fixing stay 601 as a main strength member. A 1.2 mm thick zin-coated steel plate is used as the material of the upper fixing stay 601. Openings 602, 603 and 604 through which cooling air from a fan is taken into the fixing device 40 are provided, and are opened and closed by a shutter (not shown) provided with a rack movable by a pinion 605.

A rotating portion for rotating the pinion 605 is mounted in the main assembly side of the image forming apparatus and is not shown. Depending on a size of the recording material used (introduced), an opening area is intended to be changed, and therefore in that case, the opening area is changed using sensors 606 and 607.

The upper fixing stay 601 is provided with positioning holes 611 and 612 engageable with the positioning portions (inserting portions) 417 and 418 of the front side plate 402 of the fixing device frame unit 400. Further, the upper fixing stay 601 is provided with positioning holes 613, 614 and 615 (of which the hole 615 is not shown) engageable with the positioning portions (inserting portions) 419, 420 and 421 of the rear side plate 403. That is, the positioning holes 611-615 are provided so that two or more holes are linearly arranged in each of the longitudinal end portion sides.

Figure 8:
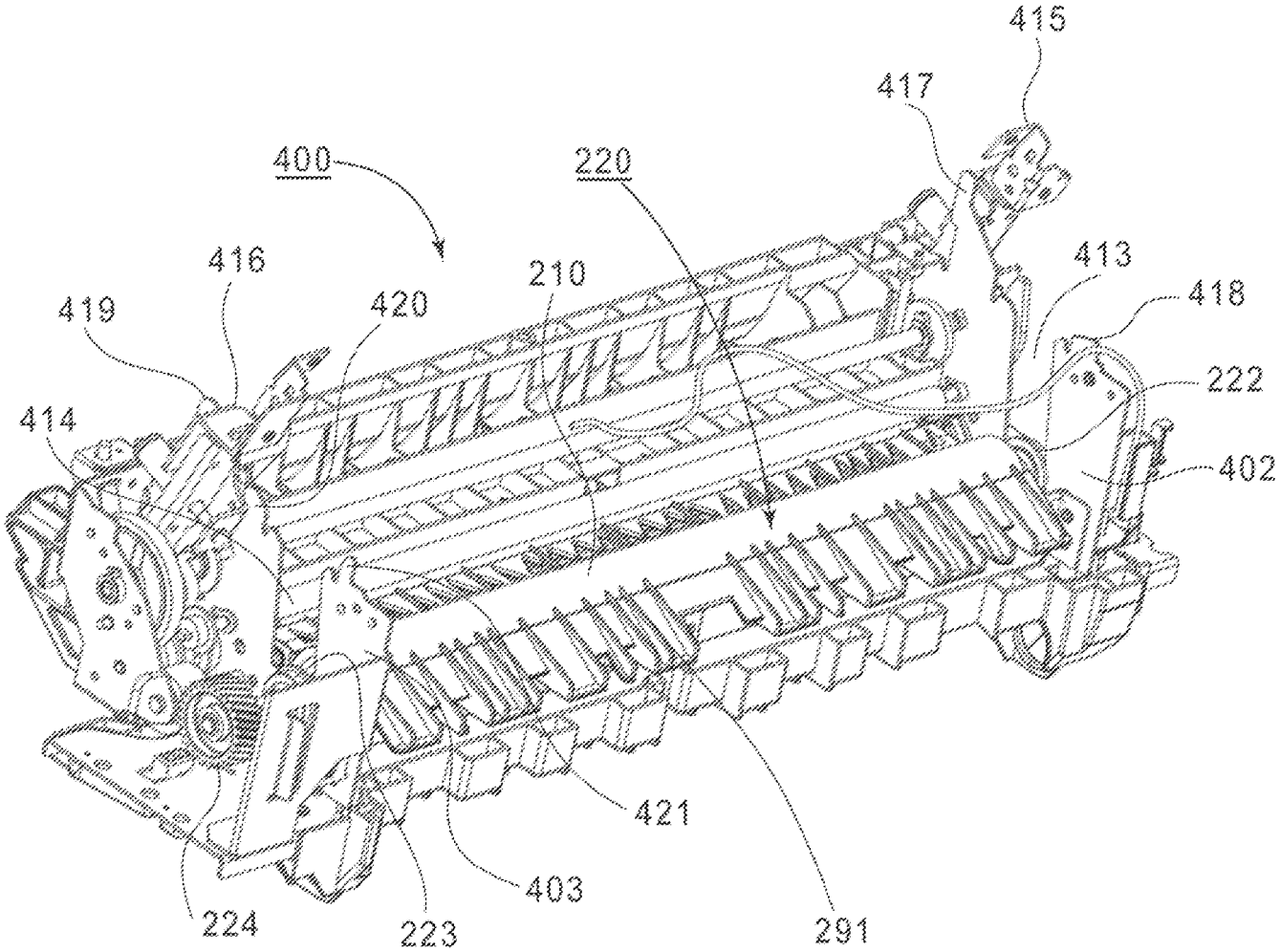
FIG. 8 is a perspective view of a state in which the pressing roller unit is assembled with the fixing device frame unit.

FIG. 8 shows a state in which the pressing roller unit 220 is mounted to the fixing device frame unit 400. After mounting the pressing roller unit 220, the entrance guide 291 is mounted.

Figure 9:
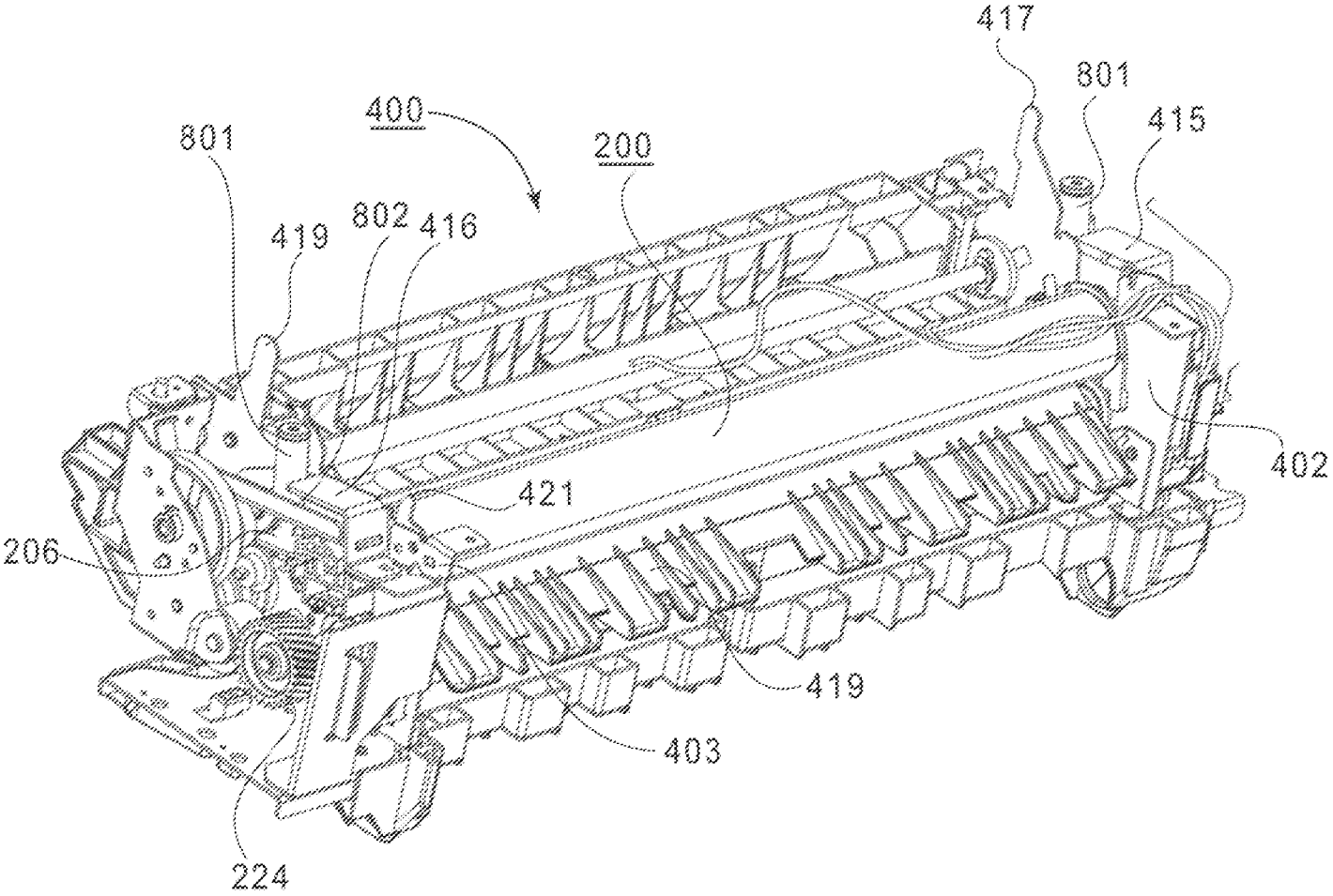
FIG. 9 is a perspective view of a state in which the fixing device frame unit is further assembled.

FIG. 9 shows a state in which the fixing film unit 200 is further mounted to the fixing device frame unit 400 put in the state of FIG. 8, and then the pressing mechanisms 415 and 416 are set. On a top of the fixing flange 206 of the fixing film unit 200, a predetermined load is exerted by a pressing spring 801 of the pressing mechanism 416 through a pressing arm (pressing plate) 802. As a result, a necessary pressure generates in the fixing nip N. Also on the fixing flange 207, a load is exerted by the pressing mechanism 415 similarly.

Figure 10:
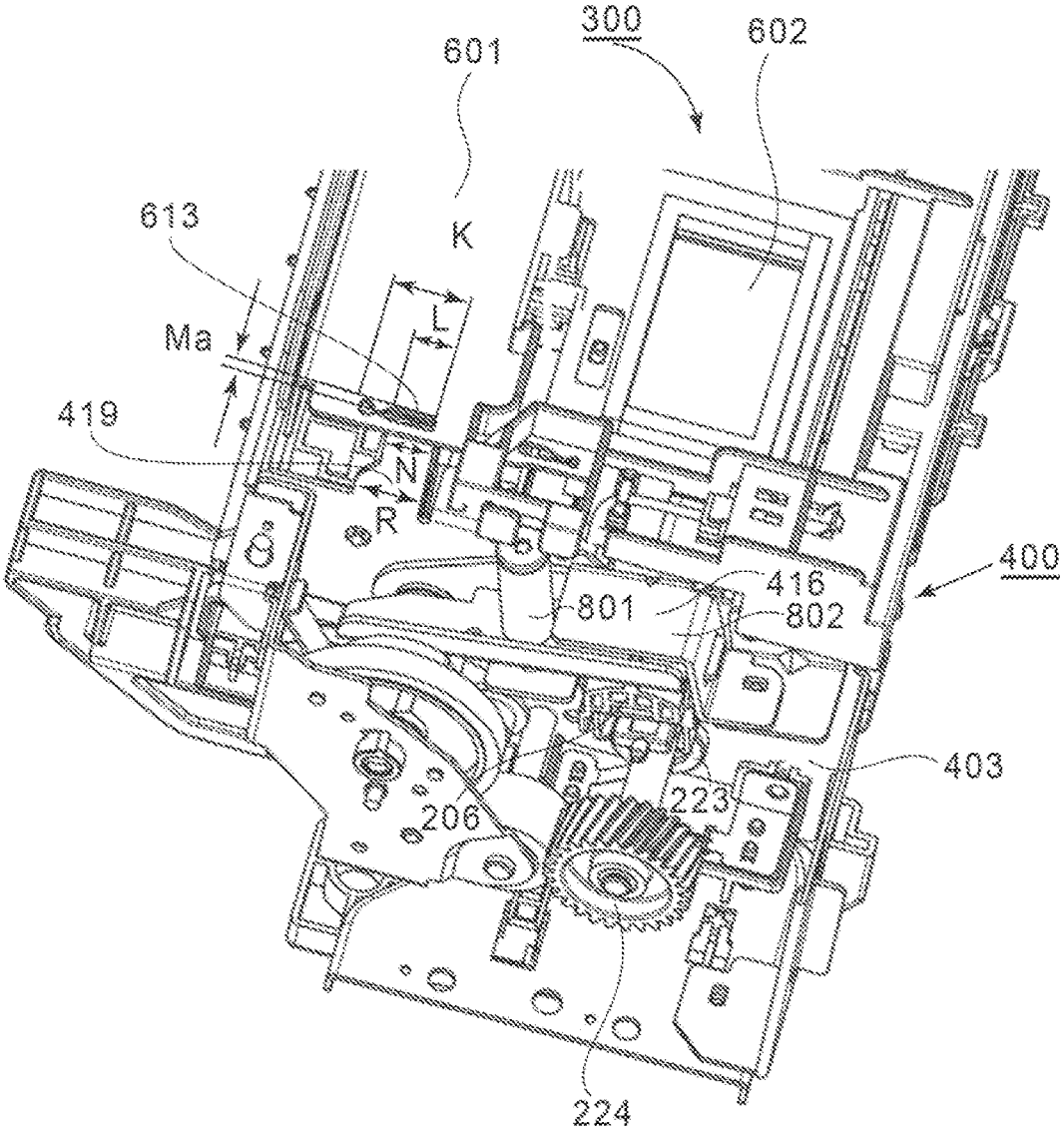
FIG. 10 is a schematic view showing a mounting process of the shutter unit.

FIG. 10 shows a state in which the shutter unit 300 is further mounted to the fixing device frame unit 400 put in the state of FIG. 9. In the case of this embodiment, the five positioning holes 611-615 of the upper fixing stay 601 and the five positioning portions (inserting portions) 417-421 of the front and rear side plates 402 and 403 are provided. That is, a plurality of the positioning holes and a plurality of the positioning portions (inserting portions) are provided, but for convenience of explanation, in the following, the case of the positioning hole 613 and the positioning portion 419 will be described as a representative example.

Figure 1A:
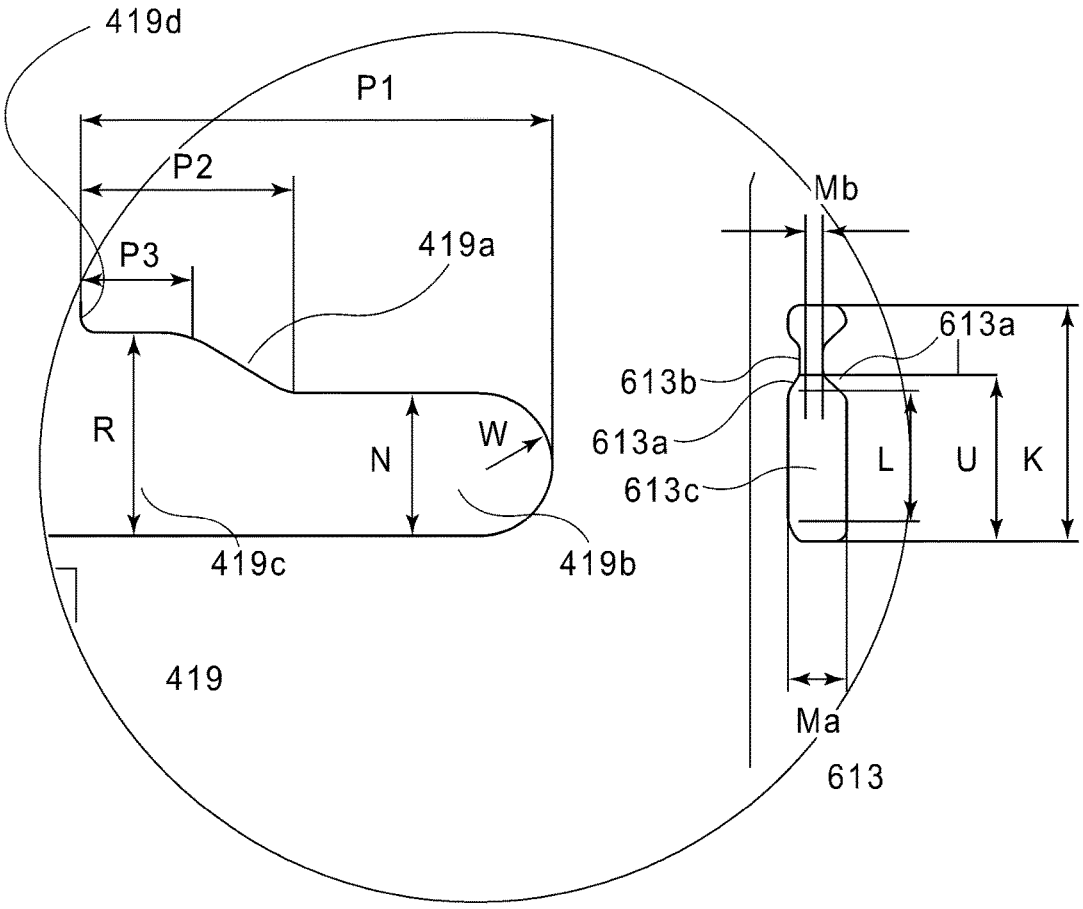
FIG. 1A is an illustration of a hole and an inserting portion of a positioning mechanism.

In FIG. 1A, details of shapes of the positioning hole 613 which is a slit portion of the upper fixing stay (first member)

601 of the shutter unit 300 and the positioning portion (inserting portion) 419 which is a plate(-like) portion of the rear side plate (second member) 403 of the fixing device frame unit 400 are shown.

The positioning hole 613 includes an introducing portion 613*c*, a first tapered portion 613*a* and an engaging portion 613*b*. The positioning portion (member) 419 includes a first inserting portion 419*b*, a second tapered portion 419*a* and a second inserting portion 419*c*. Incidentally, the tapered portions 613*a* and 419*a* which are in a relation such that they are induced (guided) by each other are not necessarily required to have a shape gradually changing in width, i.e., a linear shape. For example, the tapered portions 613*a* and 419*a* may also have a shape such that the width varies stepwisely within a range of a tolerance. Further, the tapered portions 613*a* and 419*a* may also have a shape partly including a portion having a curved shape within a range of tolerance. Thus, in this embodiment, the tapered portion can include the curved portion as described above.

A length (U: 11.6 mm) which is the same of a length of the introducing portion 613*c* and a length of the first tapered portion 613*a* of the hole 613 with respect to a longitudinal direction is longer than a width (N: 10 mm) of the first inserting portion (free end portion) 419*b* of the positioning member 419. Conversely, the width N of the first inserting portion 419*b* is set at a value shorter than the length obtained by the sum of the lengths of the introducing portion 613*c* and the first tapered portion 613*a* with respect to the longitudinal direction of the hole 613.

Further, a length (width Ma: 3.5 mm) of the introducing portion 613*c* with respect to a widthwise direction is sufficiently larger than a thickness (no reference symbol: 1.2 mm) of the positioning portion 419. For that reason, a service person can easily insert the first inserting portion 419*b* of the positioning member 419 into the introducing portion 613*c*. A free end portion of the first inserting portion 419*b* has an arcuate shape having a radius of curvature W: 5 mm), and therefore, the first inserting portion 419*b* can further easily be inserted into the introducing portion 613*c*.

When the positioning member 419 is inserted into the hole 613 by (P1-P2) and then is further inserted, the first tapered portion 613*a* and the second tapered portion 419*b* contact each other at an intermediary position of the insertion. Incidentally, in this embodiment, P1=30 mm, P2=13 mm and P3=6.8 mm are set.

When the positioning member 419 is further inserted, the second tapered portion 419*a* is guided toward the engaging portion 613*b* while sliding with the first tapered portion 613*a*. Then, a longitudinal length (no reference symbol) exceeds the length U.

Thus, the second inserting portion (positioning portion) 419*c* of the positioning member 419 starts engagement with the engaging portion 613*b* of the hole 613. When the positioning member 419 is further inserted into the hole 613 by (P1-P3), the second inserting portion 419*c* with a width (length) (R: 14 mm) engages with the engaging portion 613*b* with reliability. In this state, the fixing device frame unit 400 and the shutter unit can be fastened with screws with accuracy.

Here, widthwise length of the engaging portion 613*b* is Mb=1.3 mm, and therefore a difference in thickness between the positioning member 419 and Mb is 0.1 mm. Thus, the hole 613 and the positioning member 419 are in such a loose fitting state between the engaging portion 613*b* and the second inserting portion 419*c*. This difference may desirably be 0 mm or more and 0.12 mm or less, more desirably be 0 mm or more and 0.07 mm or less.

The above-described positioning mechanism is summarized as follows. The first member 601 is provided with the hole 613, and the second member 403, different from the first member 601, is provided with the positioning member 419 to be inserted into the hole 613. Then the hole 613 and the positioning member 419 are combined with each other to set the relative position between the first and second members 601 and 403.

The hole 613 includes the introducing portion 613*c* having the width Ma larger than the thickness of the positioning member 419, the engaging portion (positioning portion) 613*b* having the width Mb substantially equal to the thickness of the positioning member 419, and the first tapered portion 613*a* connecting between the portions 613*c* and 613*b*.

The positioning member 419 includes the first inserting portion 419*b* having the width (length) N shorter than the length U which is the sum of the lengths of the introducing portion 613*c* and the first tapered portion 613*a* of the hole 613 with respect to the longitudinal direction of the hole 613. The positioning member 419 further includes the second inserting portion 419*c* having the width (roller) R substantially equal to the length K of the hole 613. Further, the positioning member 419 includes the second tapered portion 419*a* connecting between the first inserting portion 419*b* and the second inserting portion 419*c*.

Then, the insertion of the first inserting portion 419*b* into the introducing portion 613*c* progresses, and the first tapered portion 613*a* and the second tapered portion 419*a* contact each other. Thereafter, the engaging portion 613*b* and the second inserting portion 419*c* engage with each other, so that positioning between the first and second members 601 and 403 is made. That is, a stopper portion 419*d* functioning as a positioning portion abuts a periphery of the hole 613, so that relative position between the first and second members 601 and 403 is determined with respect to a direction in which the positioning member 419 is inserted into the hole 613. As a result, with respect to each of three-dimensional directions, the relative position between the first and second members 601 and 403 is determined.

By providing such a positioning mechanism, during an assembling operation of the shutter unit 300 including the upper fixing stay 601 with the fixing device frame unit 400, there is no need to intentionally effect the positioning therebetween. That is, even in such an image that the shutter unit 300 is subconsciously moved downward to the fixing device frame unit 400, the positioning member 419 can be inserted into a region defined by L and Ma of the hole 613.

Figure 11:
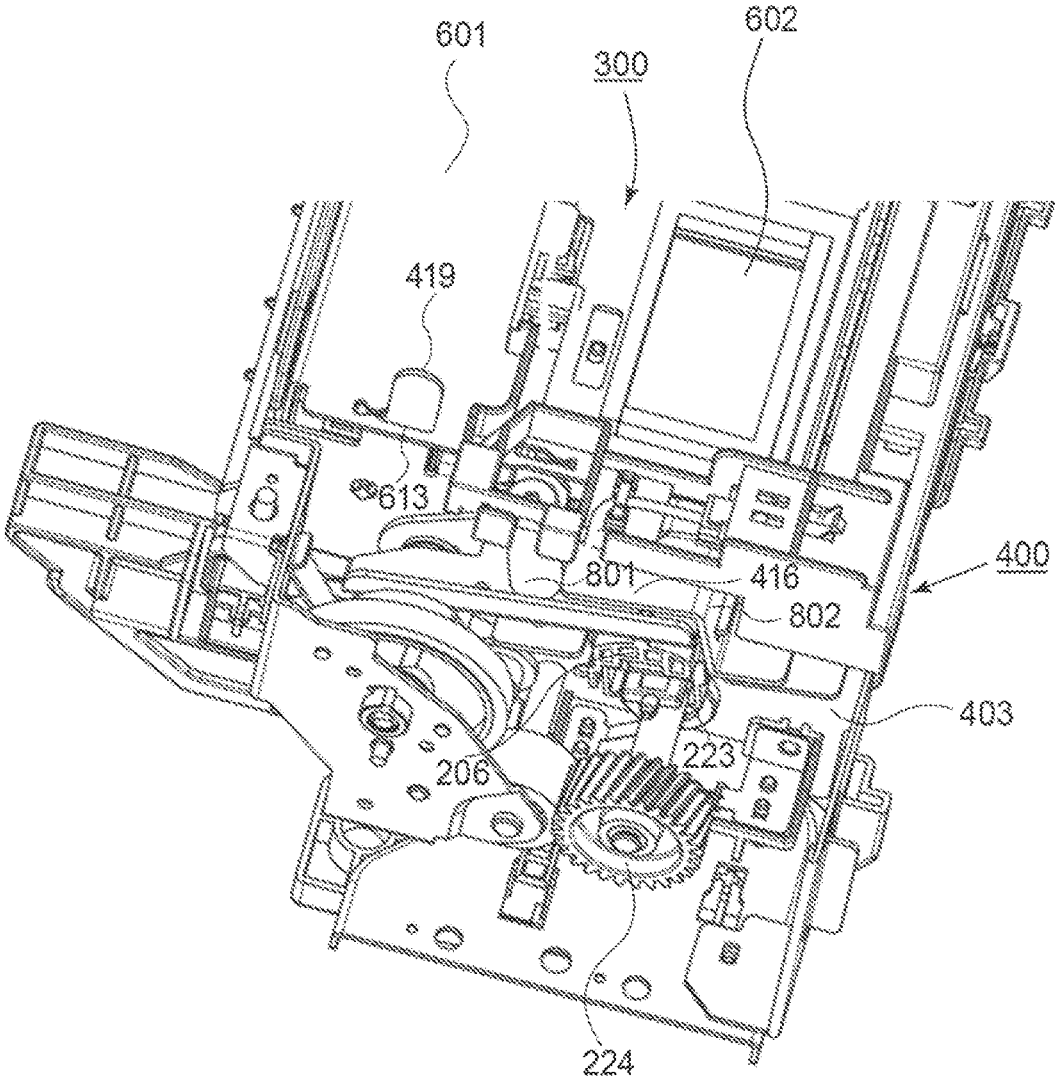
FIG. 11 is a schematic view showing the mounting process of the shutter unit.

FIG. 11 shows a state in which engagement between the positioning member 419 and the positioning hole 613 is further progressed from an initial engagement state (in which the first inserting portion 419*b* is inserted into the introducing portion 613*c*) between the positioning member 419 and the positioning hole 613 shown in FIG. 10. That is, FIG. 11 is a schematic view showing a state in which the first tapered portion 613*a* provided as a part of the positioning hole 613 of the upper fixing stay 601 and the second tapered portion 419*a* provided as a part of the positioning member 419 of the rear side plate 403 engage with each other. As described above, by an inclination effect of the first and second tapered portions 613*a* and 419*a* provided as the parts of the positioning hole 613 and the positioning member 419, respectively, the inclination of the positioning member (portion) 419 is corrected.

Figure 12:
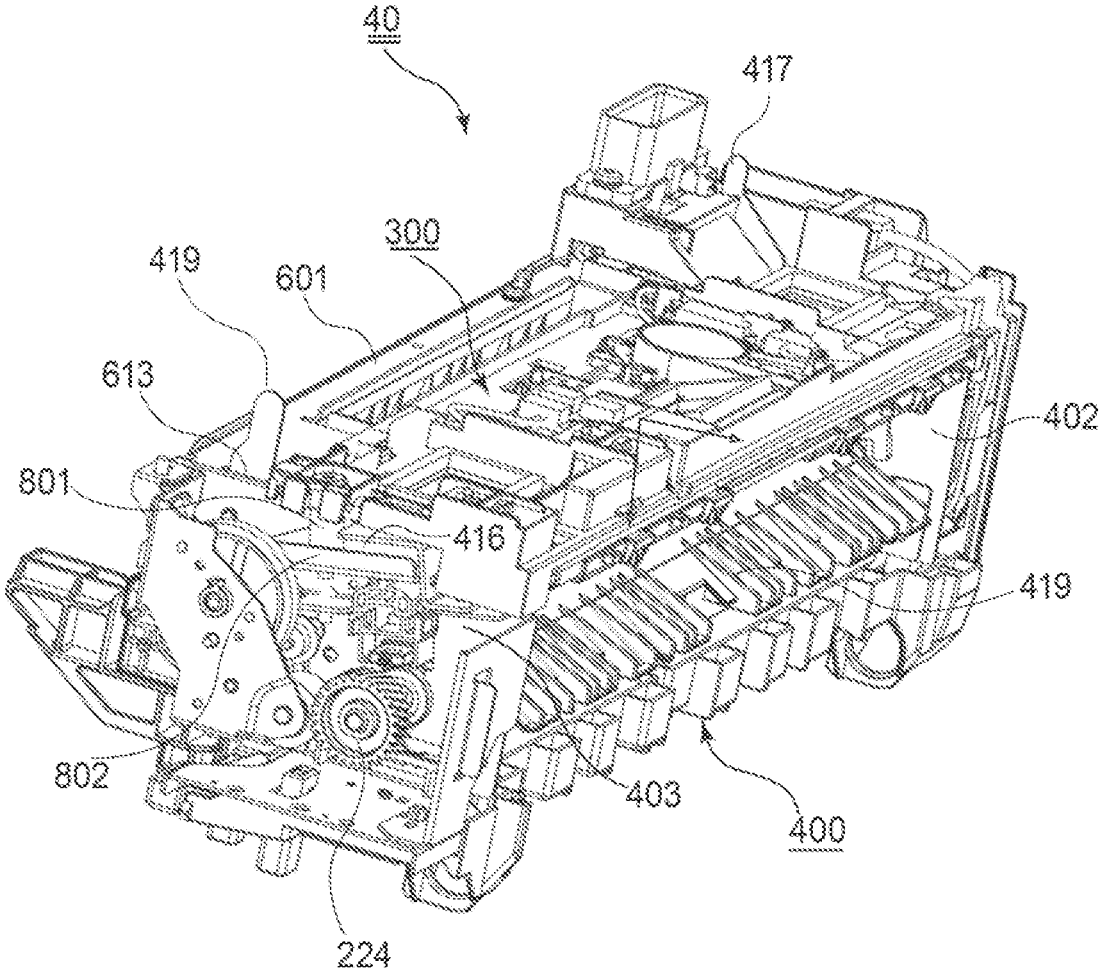
FIG. 12 is a schematic view showing completion of the mounting process of the shutter unit.
Figure 13:
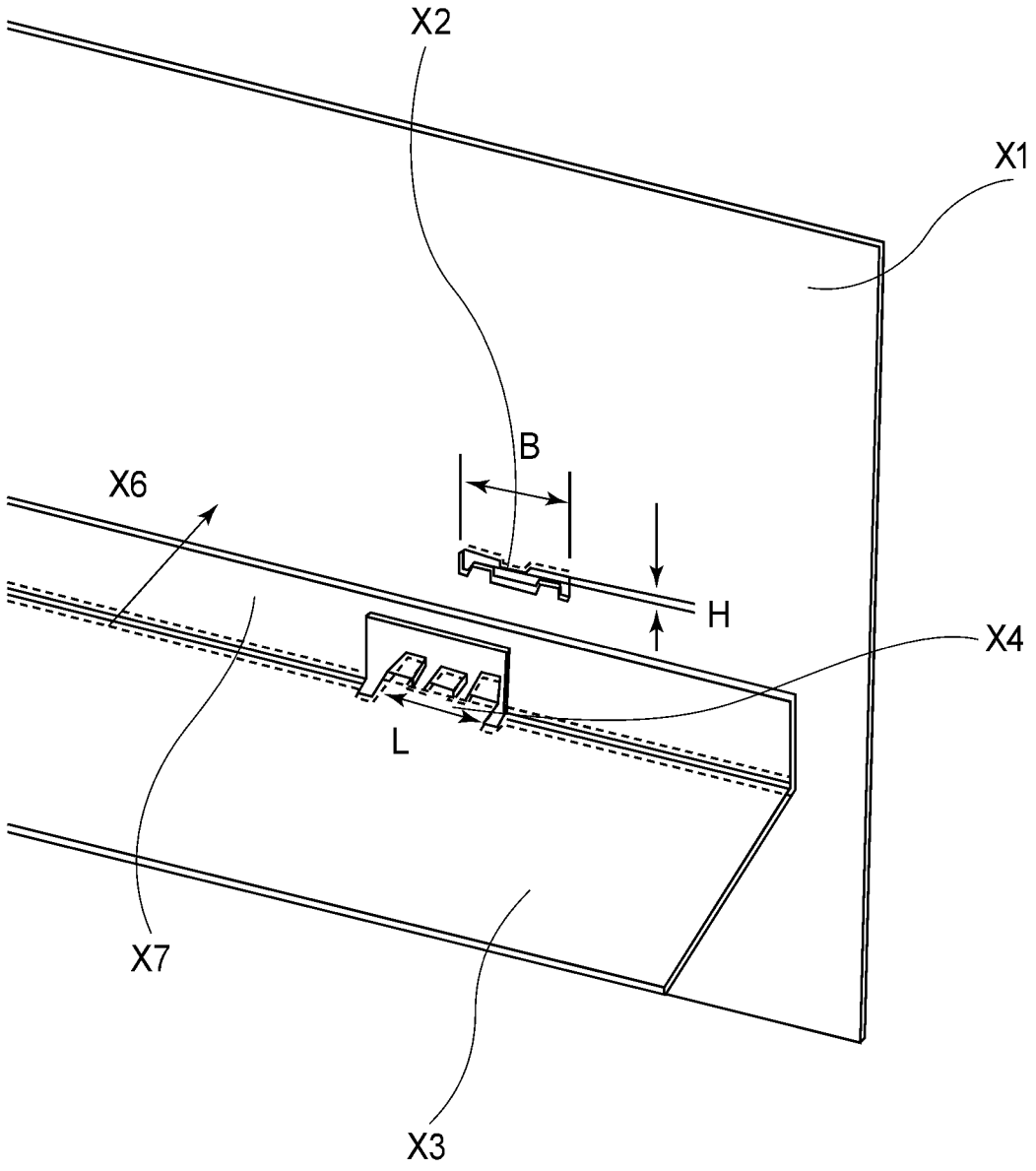
FIG. 13 is an illustration of Reference Example 1.
Figure 14:
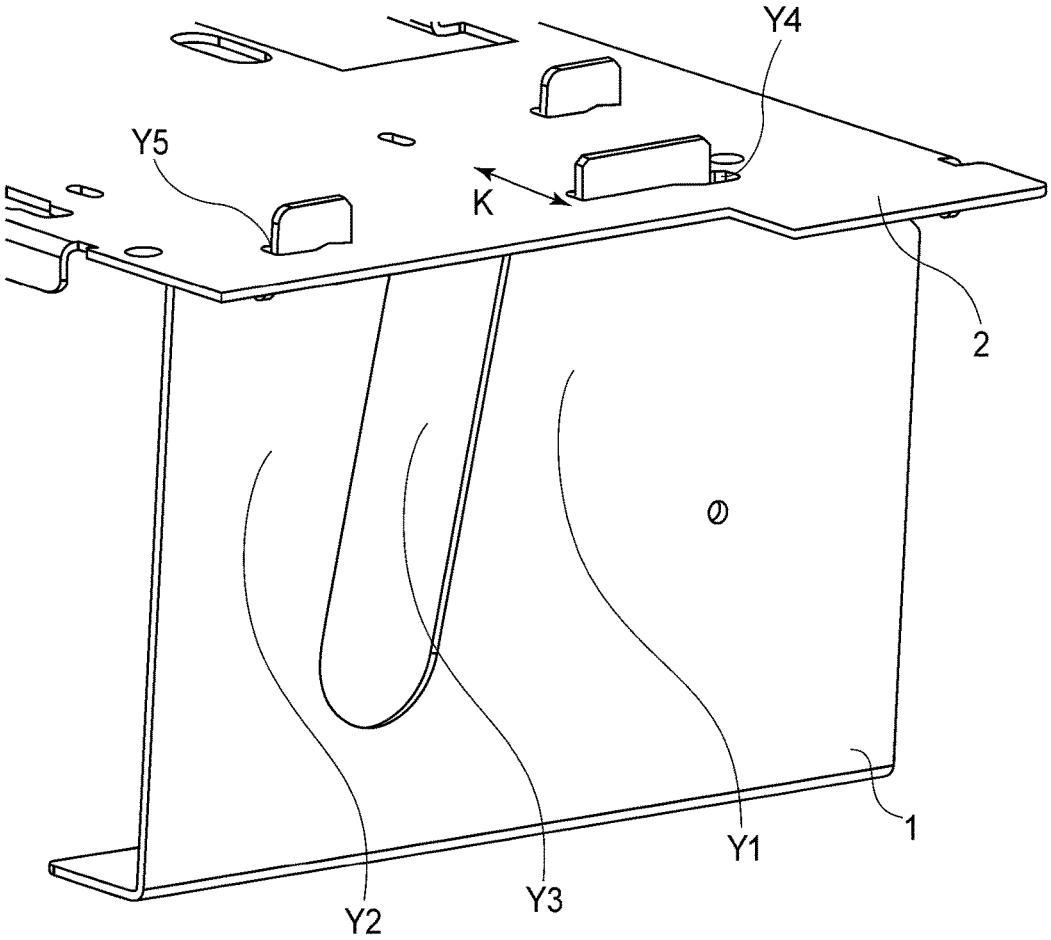
FIG. 14 is an illustration of Reference Example 2.
Figure 15:
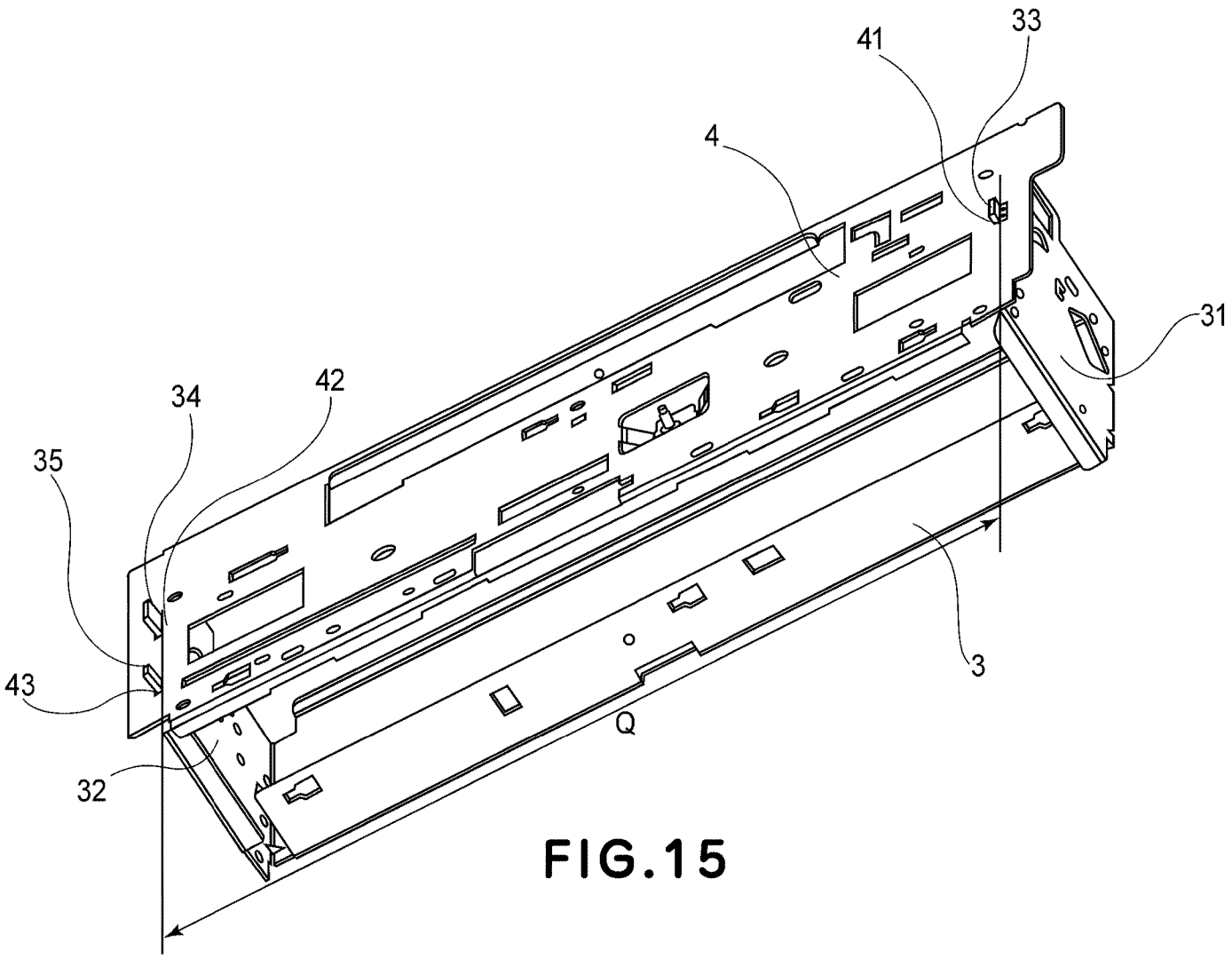
FIG. 15 is an illustration of Reference Example 3.

FIG. 12 shows a state in which the shutter unit 300 is further moved toward the fixing device frame unit 400 side from the state of FIG. 11 and thus is set to the fixing device frame unit 400 (i.e., a schematic view showing completion of mounting of the shutter unit 300). In this state, the region R of the positioning member 419, i.e., a plate thickness portion of the second inserting portion 419*c* of the positioning member 419 engages with the engaging portion 613*b* (Mb) of the positioning hole 613, so that positioning of the positioning member 419 with respect to a plate thickness direction is made.

In the case where the shutter unit 300 is demounted from the fixing device frame unit 400, an operation which is the reverse of the above-described operation is performed. An operation of eliminating the positioning from the state of the positioning of the positioning member 419 with respect to the plate thickness direction is performed, and therefore this operation does not constitute an obstacle to the demounting operation.

Therefore, by providing the positioning mechanism as described above, an assembling operation and a disassembling operation of the structure can be smoothly performed. Accordingly, effects such that an exclusive assembling tool is not needed, that the number of assembling steps is reduced, and that operativity of the users or the service person is improved are obtained.

As described above, the pressing mounts 415 and 416 includes the pressing arms 802. Each of the pressing arms 802 rotates about a pressing shaft (no reference symbol). The pressing shaft is provided on the fixing device frame unit 400. Further, the pressing arm 802 causes the pressing spring 801 to act between the shutter unit 300 and the fixing film unit 200. On each of the pressing arms 802, a force of 150 N is exerted, so that at both end portions of the fixing film unit 200, a force of 300 N in total is applied to the pressing arms 802. For that reason, by reaction of the force, a similar force is exerted between the fixing device frame unit 400 and the shutter unit 300.

Here, when assembling accuracy between the fixing device frame unit 400 and the shutter unit 300 is not high, it becomes difficult to properly press the fixing film unit 200, so that generation of an image defect such as density non-uniformity is invited. Or, in the case where the fixing device frame unit 400 and the shutter unit 300 are mounted in a distorted state, there is a liability that the pressure of the pressing springs 801 acts on the fixing device frame unit 400 and the shutter unit 300 in an unexpected direction and thus the fixing device frame unit 400 and the shutter unit 300 are deformed. For this reason, the constitution of this embodiment in which the assembling can be made with high accuracy is desirable.

Figure 1B:
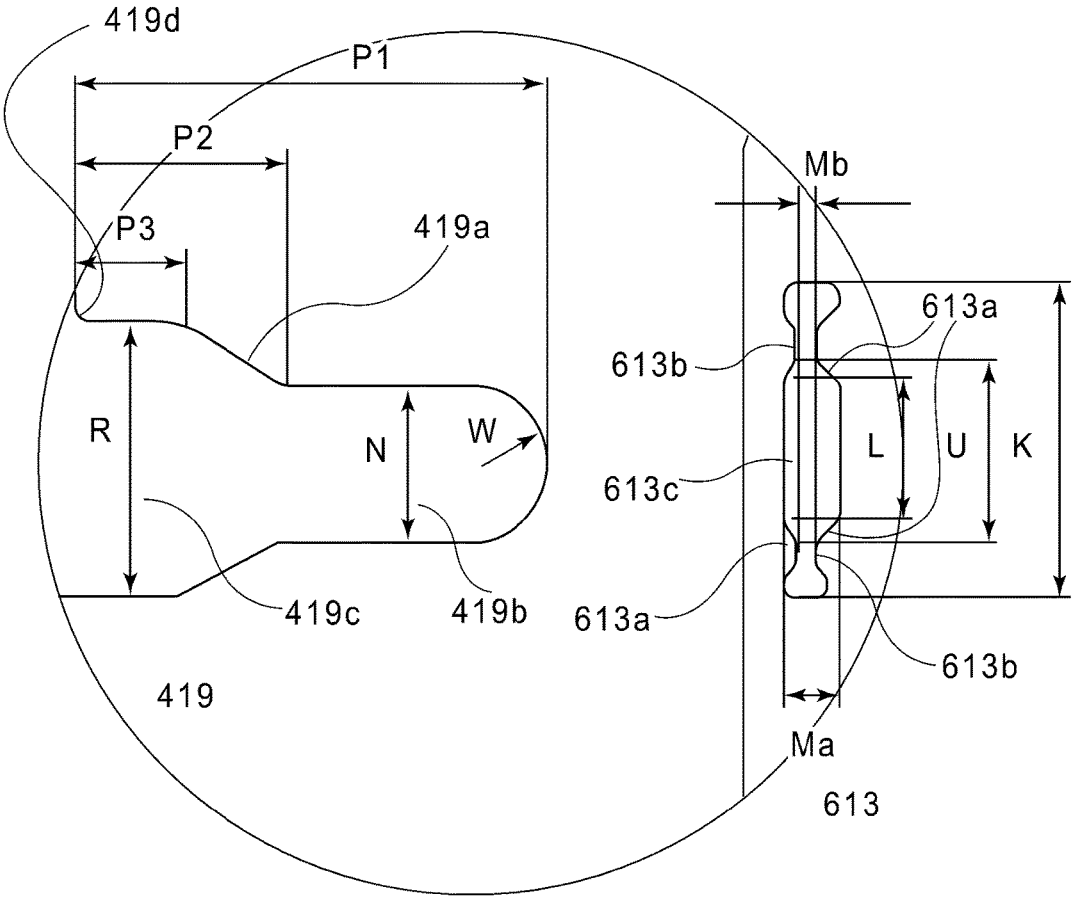
FIG. 1B is an illustration of a hole and an inserting portion of another positioning mechanism.

In FIG. 1A, the positioning hole 613 includes the engaging portion 613*b* via the first tapered portion 613*a* only in one end side of the introducing portion 613*c*. The present invention is not limited thereto, but as shown in FIG. 1B, it is also possible to employ a constitution in which in both end sides of the introducing portion 613*c*, two engaging portions 613*b* are provided via first tapered portions 613*a*. In this case, the positioning member 419 includes two second tapered portions 419*a* provided correspondingly to the two first tapered portions 613*a* provided in the both end sides the introducing portion 613*c*.

In the above-described embodiment, as the structure which holds the parts to be exchanged and which is to be mounted in the apparatus main assembly of the image forming apparatus, the fixing device is described as an example, but the structure is not limited to the fixing device. The positioning mechanism in the present invention applicable to the structure is not limited to the structure mounted in the apparatus main assembly of the image forming apparatus, but may also be widely be applicable as a positioning mechanism in the case where the first member and the second member which are demounted and mounted during exchange of the parts are positioned and connected with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176440 filed on Sep. 8, 2015, which is hereby incorporated by reference herein in its entirety.

What is claimed is:

1. A unit mountable to an image forming apparatus, the unit comprising:

a rotatable member;

a first frame including (i) a first slit portion having a widthwise direction and a longitudinal direction and (ii) a second slit portion; and a second frame including (i) a groove portion configured to rotatably hold said rotatable member, (ii) a first plate portion engaged with said first slit portion to position said second frame relative to said first frame and (iii) a second plate portion provided in a side opposite from said first plate portion so as to sandwich said groove portion with respect to the longitudinal direction of said first slit portion and having a size capable of entering said second slit portion, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

2. The unit according to claim 1, wherein the length in the widthwise direction of said first positioning portion is greater than a thickness of said first plate portion, and wherein a difference between the length in the widthwise direction of said first positioning portion and the thickness of said first plate portion is 0.12 mm or less.

3. The unit according to claim 1, wherein, a length of said free end portion in the longitudinal direction of said first slit portion is less than the length of said introducing portion in the longitudinal direction of said first slit portion.

4. The unit according to claim 1, wherein said second positioning portion contacts an edge of said first slit portion with respect to the longitudinal direction of said first slit portion so as to position said first plate portion with respect to the longitudinal direction of said first slit portion.

5. The unit according to claim 1, wherein said third positioning portion contacts said first frame so as to position said first plate portion with respect to a direction in which said plate portion is inserted into said first slit portion to engage said first plate portion and said first slit portion.

6. The unit according to claim 5, wherein said third positioning portion contacts an outside of said first slit portion with respect to the longitudinal direction of said first slit portion.

7. The unit according to claim 1, wherein the length in the widthwise direction of said first positioning portion is greater than a thickness of said first plate portion, a difference between the length in the widthwise direction of said first positioning portion and the thickness of said first plate portion being 0.12 mm or less, wherein said second positioning portion contacts an edge of said first slit portion with respect to the longitudinal direction of said first slit portion so as to position said first plate portion with respect to the longitudinal direction of said first slit portion, and wherein said third positioning portion contacts said first frame so as to position said first plate portion with respect to a direction in which said first plate portion is inserted into said first slit portion to engage said first plate portion and said first slit portion.

8. The unit according to claim 1, wherein said first frame includes a third slit portion, wherein said groove portion of said second frame rotatably holds an end portion of said rotatable member in one end side with respect to a longitudinal direction of said rotatable member, and wherein said unit further comprises a third frame which includes:

(i) a second groove portion configured to rotatably hold an end portion of said rotatable member in the other end side with respect to the longitudinal direction of said rotatable member; and (ii) a third plate portion engaged with said third slit portion to position said third frame relative to said first frame.

9. A unit according to claim 1, wherein said first slit portion and said first plate portion have such sizes that said first tapered portion and said second tapered potion are configured to be contactable with each other when said first slit portion and said first plate portion are brought into engagement.

10. The unit according to claim 1, wherein said second slit portion has a widthwise direction and a longitudinal direction and said second plate portion is engaged with said second slit portion to position said second frame relative to said first frame, wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

11. A fixing device mountable to an image forming apparatus, the fixing device comprising:

a rotatable member configured to heat a toner image on a recording material at a nip;

a first frame including (i) a first slit portion having a widthwise direction and a longitudinal direction and a (ii) second slit portion; and a second frame including (i) a groove portion configured to rotatably hold said rotatable member, (ii) a first plate portion engaged with said first slit portion to position said second frame relative to said first frame and (iii) a second plate portion provided in a side opposite from said first plate portion so as to sandwich said groove portion with respect to the longitudinal direction of said first slit portion and having a size capable of entering said second slit portion, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

12. The fixing device according to claim 11, wherein said first slit portion and said first plate portion have such sizes that said first tapered portion and said second tapered potion are configured to be contactable with each other when said first slit portion and said first plate portion are brought into engagement.

13. The fixing device according to claim 11, wherein said second slit portion has a widthwise direction and a longitudinal direction, and said second plate portion is engaged with said second slit portion to position said second frame relative to said first frame, wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

14. The fixing device mountable to an image forming apparatus, the fixing device comprising:

a rotatable member configured to form a nip, for fixing a toner image, in cooperation with a rotatable heating member configured to heat the toner image on a recording material;

a first frame including (i) a first slit portion having a widthwise direction and a longitudinal direction and (ii) a second slit portion; and a second frame including (i) a groove portion configured to rotatably hold said rotatable member (ii) a first plate portion engaged with said first slit portion to position said second frame relative to said first frame and (iii) a second plate portion provided in a side opposite from said first plate portion so as to sandwich said groove portion with respect to the longitudinal direction of said first slit portion and having a size capable of entering said second slit portion, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

15. The fixing device according to claim 14, wherein said first slit portion and said first plate portion have such sizes that said first tapered portion and said second tapered potion are configured to be contactable with each other when said first slit portion and said first plate portion are brought into engagement.

16. The fixing device according to claim 14, wherein said second slit portion has a widthwise direction and a longitudinal direction, and said second plate portion is engaged with said second slit portion to position said second frame relative to said first frame, wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

17. A unit mountable to an image forming apparatus, the unit comprising:

a rotatable member;

a first frame including (i) a first slit portion having a widthwise direction and a longitudinal direction and (ii) a second slit portion;

a second frame including (i) a first groove portion configured to rotatably hold an end portion of said rotatable member in one end side with respect to a longitudinal direction of said rotatable member, and (ii) a first plate portion engaged with said first slit portion to position said second frame relative to said first frame, and a third frame including (i) a second groove portion configured to rotatably hold an end portion of said rotatable member in the other end side with respect to the longitudinal direction of said rotatable member; and (ii) a second plate portion engaged with said second slit portion to position said third frame relative to said first frame, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

18. The unit according to claim 17, wherein said second slit portion has a widthwise direction and a longitudinal direction, and wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

19. A fixing device mountable to an image forming apparatus, the fixing device comprising:

a rotatable member configured to heat a toner image on a recording material at a nip; a first frame including (i) a first slit portion having a widthwise direction and a longitudinal direction and (ii) a second slit portion;

a second frame including (i) a first groove portion configured to rotatably hold an end portion of said rotatable member in one end side with respect to a longitudinal direction of said rotatable member, and (ii) a first plate portion engaged with said first slit portion to position said second frame relative to said first frame, and a third frame including (i) a second groove portion configured to rotatably hold an end portion of said rotatable member in the other end side with respect to the longitudinal direction of said rotatable member; and (ii) a second plate portion engaged with said second slit portion to position said third frame relative to said first frame, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

20. The fixing device according to claim 19, wherein said second slit portion has a widthwise direction and a longitudinal direction, and wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

21. A fixing device mountable to an image forming apparatus, the fixing device comprising:

a rotatable member configured to form a nip, for fixing a toner image, in cooperation with a rotatable heating member configured to heat the toner image on a recording material;

a first frame including (i) a first slit portion having a widthwise direction and a longitudinal direction and (ii) a second slit portion;

a second frame including (i) a first groove portion configured to rotatably hold an end portion of said rotatable member in one end side with respect to a longitudinal direction of said rotatable member, and (ii) a first plate portion engaged with said first slit portion to position said second frame relative to said first frame, and a third frame including (i) a second groove portion configured to rotatably hold an end portion of said rotatable member in the other end side with respect to the longitudinal direction of said rotatable member; and (ii) a second plate portion engaged with said second slit portion to position said third frame relative to said first frame, wherein said first slit portion includes:

(a) a first positioning portion (i) having a length in the widthwise direction of said first slit portion and (ii) configured to position said first plate portion with respect to the widthwise direction of said first slit portion, (b) an introducing portion having a length in the widthwise direction longer than the length of said first positioning portion in the widthwise direction, and (c) a first tapered portion connecting said first positioning portion and said introducing portion, and wherein said first plate portion includes:

(a) a free end portion having a size capable of entering said introducing portion of said first slit portion to engage said first slit portion with said first plate portion, (b) a second positioning portion configured to position said first plate portion with respect to the longitudinal direction of said first slit portion, (c) a second tapered portion connecting said free end portion and said second positioning portion, (d) a third positioning portion contacting said first frame so as to position said first plate portion with respect to a direction normal to a surface of said first frame.

22. The fixing device according to claim 21, wherein said second slit portion has a widthwise direction and a longitudinal direction, and wherein said second slit portion includes:

(a) a fourth positioning portion (i) having a length in the widthwise direction of said second slit portion and (ii) configured to position said second plate portion with respect to the widthwise direction of said second slit portion, (b) a second introducing portion having a length in the widthwise direction of said second slit portion longer than the length of said fourth positioning portion in the widthwise direction of said second slit portion, and (c) a third tapered portion connecting said fourth positioning portion and said second introducing portion, and wherein said second plate portion includes:

(a) a second free end portion having a size capable of entering said second introducing portion of said second slit portion to engage said second slit portion with said second plate portion, (b) a fifth positioning portion configured to position said second plate portion with respect to the longitudinal direction of said second slit portion, (c) a fourth tapered portion connecting said second free end portion and said fifth positioning portion, (d) a sixth positioning portion contacting said first frame so as to position said second plate portion with respect to the direction normal to the surface of said first frame.

* * * * *